United States Patent [19]

Shields

[11] 4,176,725

[45] Dec. 4, 1979

[54] EARTH BORING CUTTING ELEMENT ENHANCED RETENTION SYSTEM

[75] Inventor: Santos Shields, Arlington, Tex.

[73] Assignee: Dresser Industries, Inc., Dallas, Tex.

[21] Appl. No.: 934,292

[22] Filed: Aug. 17, 1978

[51] Int. Cl.[2] ..... E21B 9/08

[52] U.S. Cl. ..... 175/374; 175/410

[58] Field of Search ..... 175/410, 374

[56] References Cited

U.S. PATENT DOCUMENTS

| | | | |
|---|---|---|---|
| 3,357,507 | 12/1967 | Stewart | 175/410 |
| 3,389,761 | 6/1968 | Ott | 175/374 |
| 3,461,983 | 8/1969 | Hudson et al. | 175/375 |
| 3,513,728 | 5/1970 | Hudson et al. | 76/108 |
| 3,599,737 | 8/1971 | Fischer | 175/374 |
| 4,047,583 | 9/1977 | Dyer | 175/410 |

*Primary Examiner*—James A. Leppink
*Assistant Examiner*—Richard E. Favreau
*Attorney, Agent, or Firm*—Eddie E. Scott

[57] ABSTRACT

An earth boring apparatus includes individual cutting elements positioned within corresponding individual sockets in the cutter member body of the earth boring apparatus. Each socket has a socket wall and bottom. Each cutting element has a lower body portion positioned in the socket with a surface that contacts the socket wall and a bottom surface. The bottom surface has a conical taper. This causes compressive loads to press the lower body portion against the socket wall enhancing retention and reducing cutting element loss.

2 Claims, 5 Drawing Figures

EARTH BORING CUTTING ELEMENT ENHANCED RETENTION SYSTEM

BACKGROUND OF THE INVENTION

The present invention relates in general to the art of earth boring and more particularly to a system for retaining the cutting elements in the cutter member body of an earth boring apparatus.

Cutting element life and efficiency are of prime importance in boring holes in the earth. For example, cutting element life and efficiency are important in drilling oil and gas wells and boring tunnels and raise holes. In general, the penetration rate is directly related to the condition of the cutter member and the condition of the cutter member is related to the condition and orientation of the cutting elements.

Cutter members having carbide insert cutting elements located in the body of the cutter member are generally utilized because of the ability of the carbide insert cutting elements to penetrate hard formations. The carbide inserts are mounted in a relatively soft metal forming the body of the cutter member. The most commonly used method of securing the inserts in the cutter member body is to provide cylindrical sockets in the cutter member body, to mold the inserts into a cylindrical shape, and to pressfit the inserts in the sockets in the cutter member body. The inserts are retained in the cutter member body by "hoop" compression generated when the insert is pressed into the relatively soft cutter member body. A frequent cause of short cutting element life and related physical damage to cones, arms and other cutter members is the loss of carbide insert cutting elements, generally designated as compacts, from their physical position in the cone. When these compacts are lost during drilling by the forces related to crushing and breaking rock in the process of drilling the hole, these compacts due to their very hard material properties cause considerable damage to the rest of the cutting structure by becoming enmeshed or wedged between two or more cones. This results in chippage and breaking of other compacts and can result in serious damage to the bit which must then be removed and replaced. This need for early removal of the bit from the hole and replacing it with a new bit is very costly and time consuming and increases the cost of drilling the hole.

Typically the inserts have been generally cylindrical sections pressed into radial cylindrical sockets in the cutter member. Since the cutter member has a circular cross-section, the interference fit at the lower portion of the socket causes expansion of the socket at the upper portion and loss of fit along the length of the insert. The loss of fit results in the inserts becoming loosened in the cutter member body and premature failure of the cutter member. It is common practice to design the press fit of every compact in every row to a constant and relatively high value of interference which results in large induced stresses throughout the cone. When these stresses add to applied stresses, which occur during normal bit operation, the resultant total stresses cause yielding of the cone material and often result in either loss of compacts or fracture of the cone with subsequent failure of the drill bit. The present invention permits the use of lower initial interference fit for the compacts, yet results in high local retention stresses which promote insert retention of those compacts experiencing maximum load at the bottom of the hole by providing increased friction between compact and hole.

BRIEF DESCRIPTION OF PRIOR ART

In U.S. Pat. No. 3,389,761 to Eugene G. Ott, patented Aug. 25, 1968, a rotary drill bit is shown including a rolling cutter having sintered metallic carbide inserts located in the cutter surface. The inserts include a plurality of alternate ridges and valleys on the side surface thereof that are sized to engage the walls of the holes in the roller cutter whereby the inserts are retained in the rolling cutter against both longitudinal and rotational movement relative to the cutter.

In U.S. Pat. Nos. 2,097,030 and 2,121,202 to R. J. Kilgore, patented Oct. 26, 1937 and June 21, 1978 respectively, a rock drill bit is shown in which hard metal inserts are tapered inwardly and are seated in tapered openings formed in the bottom of the bit. The tapered inserts do not bottom in the tapered openings and are accordingly held against being driven into the engagement with the bottoms of the openings by the tapered side walls of the openings. The walls of the openings press forcibly against the inserts and tend to compress the inserts radially as well as prevent or resist inward movement of the inserts in their tapered openings.

In U.S. Pat. Nos. 3,461,983 and 3,513,728 to Lester S. Hudson and Eugene G. Ott jointly, patented Aug. 19, 1969 and May 26, 1970 respectively, an apparatus is shown that includes a member having a surface thereon exposed to an abrasive environment, the member having a relatively hard insert pressed into a hole in the member and having a hardfacing material on the surface of the member surrounding the insert. A method of manufacturing the apparatus is shown wherein the hole is plugged and hardfacing material is applied to the surface around the plug. After the hardfacing material has been permanently bonded to the surface, the plug is removed and the hard insert pressed into the hole to complete the apparatus.

In U.S. Pat. No. 3,599,737 to John F. Fisher, patented Aug. 17, 1971, a drilling tool or the like is shown with hardened metal inserts of molded sintered metal turned to cylindrical shape by centerless grinding and provided, prior to centerless grinding, with out-of-round abutment portions, the inserts being press-fitted into cavities in the cutter and the material of the cutter being staked to displace metal into engagement with the out-of-round abutment portions of the inserts to prevent axial and rotational displacement.

In U.S. Pat. No. 3,749,190 to Clarence S. Shipman, patented July 31, 1973, a rock drill bit having tapered carbide buttons projecting from its working face is described in which the buttons are retained in the bit by means of sleeves which are extruded into undercuts of the button holes and retain the carbide buttons in the drill bit by virtue of the shear strength of the sleeves.

In U.S. Pat. No. 4,047,583 to Norman D. Dyer, patented Sept. 13, 1977, an earth boring cutter element retention system is shown. An earth boring apparatus includes individual cutting elements positioned within corresponding individual sockets in the cutter member body of the apparatus. Each socket has a socket wall and each cutting element has a lower body portion with a surface that contacts the socket wall. In one embodiment the sockets are cylindrical and substantial portion of the lower body surfaces have a conical taper. This provides an improved fit of the lower body surface along the length of the socket wall and reduces cutting element loss.

SUMMARY OF THE INVENTION

The present invention provides an earth boring apparatus having hardened inserts or compacts positioned in sockets in the cutter body of the apparatus. The present invention will help eliminate loss of compacts (inserts), due to overloads, and help eliminate compacts rotating from initially installed azimuth position in the cone. This invention will also reduce the amount of tungsten carbide required for compacts and thus effect a financial savings. The present invention uses available compression loads to press the compact against the wall of the hole to enhance the retention effects of friction. In the preferred embodiment, holes are drilled in the cutter body. The holes have a conical shaped bottom. In another embodiment, a small, solid cone shaped element is placed in the bottom of the cylindrical hole cavity prior to pressing the insert into the cavity. The above and other features and advantages of the present invention will become apparent from a consideration of the following detailed description of the invention when taken in conjunction with the accompanying drawings.

DETAILED DESCRIPTION OF THE INVENTION

Figure 1:
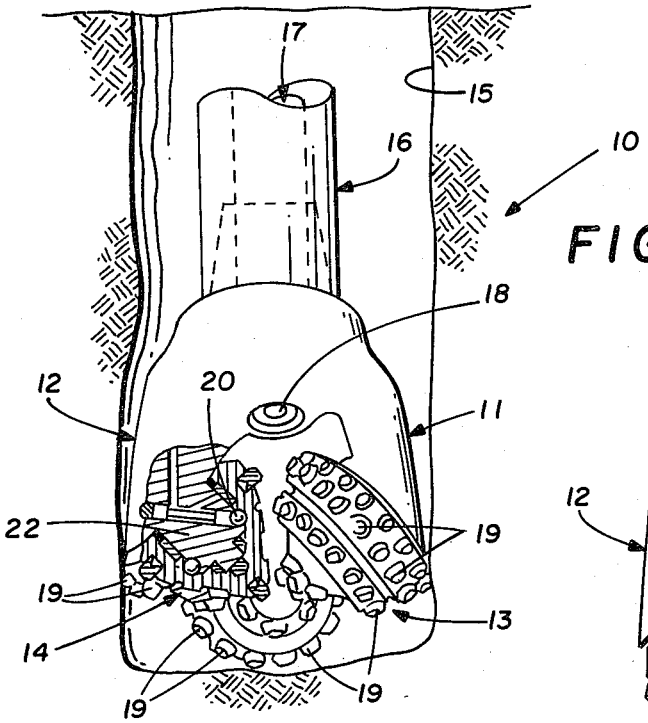
FIG. 1 is a partially cut-away illustration of a rock bit incorporating the present invention.

Referring now to the drawings and to FIG. 1 in particular, a rotary rock bit generally designated by the reference number 10 is positioned in an earth borehole 15. As illustrated, the rotary rock bit 10 is connected to the lower end of a rotary drill string 16. The bit 10 and drill string 16 include an internal cavity 17 that extends through the upper portion of the bit 10. A multiplicity of nozzles 18 allow drilling fluid to be circulated through the drill string 16 and to be discharged to the bottom of the borehole 15 thereby flushing cuttings and debris from the bottom of the borehole 15. The cuttings and debris are carried upward in the annulus between the drill string 16 and the wall of the borehole 15.

Figure 2:
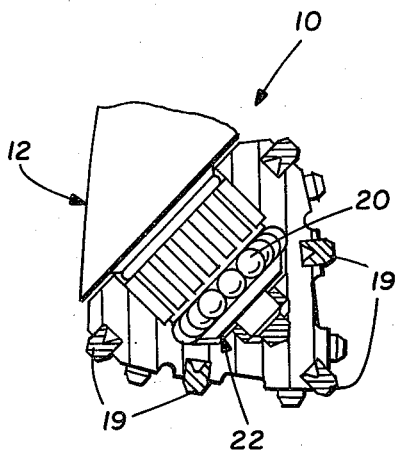
FIG. 2 is a partially cut-away view of a rolling cone cutter mounted on an arm of a rock bit.

FIG. 2 shows a cross section geometry of a rock bit cone and arm. This section shows how cone cutter member 14 is retained on the bearing pin 22 by ball bearings 20. FIG. 2 shows the details on an unsealed roller bearing bit compared to FIG. 1 which shows a sealed rolling cutter rock bit.

The bit 10 may include various numbers of substantially identical arms. Arms 11 and 12 are shown in FIG. 1. The cone cutter members 13 and 14 are rotatably positioned on the arms 11 and 12 respectively. The cone cutter members 13 and 14 include a multiplicity of hard inserts 19 projecting from the body of the cutter members. As the bit 10 and cutters 13 and 14 rotate, the inserts contact and disintegrate the rock formations to form the desired borehole.

Figure 3:
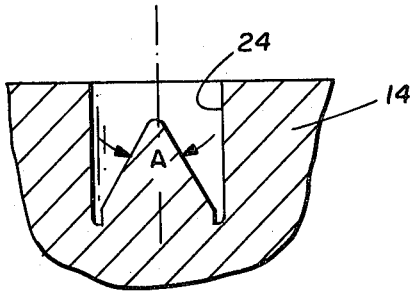
FIG. 3 shows a sectional view illustration of one of the sockets in the cone cutter of the rock bit shown in FIGS. 1 and 2.

Referring now to FIG. 3, an illustration of one of the sockets 24 that extend into the cone cutter 14 is provided. The insert to be positioned in socket 24 has a lower base section adapted to be positioned in the socket 24. The base section of the insert is pressed through the socket mouth into the socket. The bottom surface of the socket is tapered forming a conical projection. The angle "A" of the taper of the tapered surface is such that increased friction will be imparted to the tungsten carbide insert and the cone cutter member when the compact is being forced into the rock formation at the bottom of the hole during drilling. The angle "A" in the preferred embodiment is an angle of substantially 60°.

Figure 4:
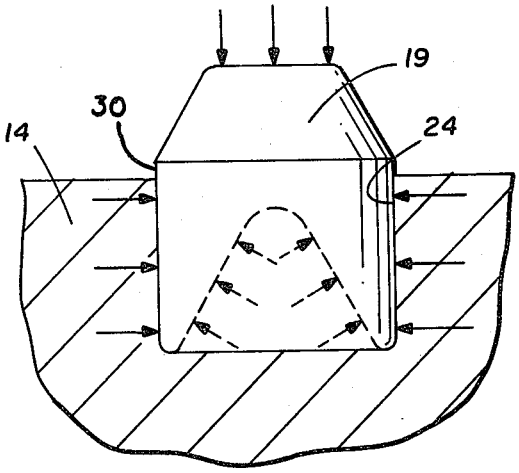
FIG. 4 shows the forces on the insert in the cone cutter shown in FIGS. 1 and 2.

The insert 19 is shown mounted in the socket 24 in FIG. 4. The insert 19 is approximately the same size and slightly larger than the diameter of the socket. The shape of the bottom of the insert 19 and the shape of the socket 24 are matching tapers. The outer surface of the base section 30 of the insert 19 is cylindrical. The insert 19 is press-fitted into the socket 24. The insert 19 will be retained in the cone cutter and the tapered surface of the bottom section and socket provides an improved fit of the insert in the socket. The arrows illustrate the reactive forces of the insert 19 and socket 24.

It has been discovered that when prior art inserts were press-fitted into the sockets on the cutter members, the walls of the sockets tended to be warped and a proper fit along the full length of the insertion was not obtained. When this happened, the inserts tended to become disoriented in the sockets during the earth boring operation and premature failure of the cutter member resulted. Cone peeling was also encountered. The increased friction forces produced by the present invention will assist in eliminating loss of compacts, due to overloads, and eliminating compacts rotating from initially installed azimuth position in the cone. It will also reduce the amount of tungsten carbide required for compacts and thus effect a financial savings in manufacture. Previous compacts depended on residual stress in the cone when an oversize compact was pressed into an undersized hole. The present invention uses available compression loads to press the compact against the wall of the hole to enhance the retention effects of friction. Retaining forces are maximum when needed.

Figure 5:
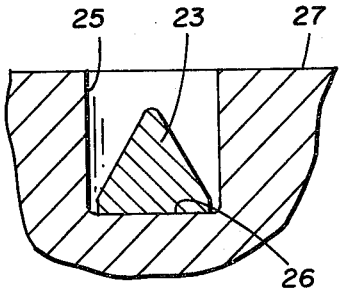
FIG. 5 illustrates another embodiment of the present invention.

Referring now to FIG. 5, another embodiment of a system constructed according to the present invention is shown. An extra fitting 23 is used in each hole to provide the conical wedge effect with a flat bottomed hole. A cylindrical hole 25 is bored into the cutter 27. The cylindrical hole or socket 25 has a flat bottom 26. The conical wedge element 23 is positioned in the socket 23 prior to inserting the insert 19. The insert 19 has a tapered bottom as shown in FIG. 4. The conical wedge element 23 and tapered bottom provided improved retention of the insert 19 in the cutter 27.

The embodiments of the invention in which an exclusive property or privilege is claimed are defined as follows:

1. In an earth boring apparatus having a body member retaining at least one insert, wherein upon assembly of said insert in said body member said insert is positioned in a socket in the body member, said insert having a bottom portion and a bottom surface being located in said socket, the improvement comprising:

at least a substantial portion of both said bottom surface of said socket and said insert bottom portion having matching tapers so that the insert and socket have an improved fit wherein said bottom surface of said socket and said insert bottom portion are in engagement causing said bottom surface of said insert to tend to diverge when assembled, said divergence increasing the friction between insert and socket.

2. In an earth boring apparatus having a body member retaining at least one insert, wherein upon assembly of said insert in said body member said insert is positioned in a socket in the body member, said insert having a bottom portion and a bottom surface being located in said socket, the improvement comprising:

at least a substantial portion of both said bottom surface of said socket and said insert bottom portion having matching tapers so that the insert and socket have an improved fit with said bottom surface of said socket and said insert bottom portion being in engagement causing said bottom surface of said insert to tend to diverge when assembled, said divergene increasing the friction between insert and socket and wherein said taper is at an angle of approximately, but not limited to, 60 degrees.

* * * * *